US005634701A

United States Patent [19]

Hendrich et al.

[11] Patent Number: 5,634,701

[45] Date of Patent: Jun. 3, 1997

[54] MULTI-DRAWER CABINET HAVING A DRAWER LOCK-OUT MECHANISM

[75] Inventors: Ronald D. Hendrich, New Albany, Ind.; Ghosn S. Ziady, Louisville, Ky.

[73] Assignee: FireKing International, Inc., New Albany, Ind.

[21] Appl. No.: 298,996

[22] Filed: Aug. 31, 1994

(Under 37 CFR 1.47)

[51] Int. Cl.[6] ..... E05C 7/06; A47B 88/00

[52] U.S. Cl. ..... 312/221; 312/222; 312/334.8

[58] Field of Search ..... 312/215, 217, 312/218, 219, 221, 222, 216, 220, 334.32, 334.8

[56] References Cited

U.S. PATENT DOCUMENTS

| | | | |
|---|---|---|---|
| 4,429,930 | 2/1984 | Blouin | 312/222 X |
| 4,441,767 | 4/1984 | Stark | 312/221 X |
| 4,480,883 | 11/1984 | Young | 312/221 X |
| 4,711,505 | 12/1987 | Lakso | 312/221 X |
| 4,770,476 | 9/1988 | Lakso | 312/221 X |
| 4,820,002 | 4/1989 | Lechner et al. | 312/221 |
| 4,838,627 | 6/1989 | Macias | 312/334 B |
| 4,854,653 | 8/1989 | Lakso | 312/222 |
| 4,889,396 | 12/1989 | Mitchell et al. | 312/221 |
| 4,957,334 | 9/1990 | Lakso | 312/221 |
| 4,966,423 | 10/1990 | Higuera et al. | 312/221 |
| 5,303,994 | 4/1994 | Elsholz | 312/222 X |
| 5,333,949 | 8/1994 | McGregor | 312/222 X |
| 5,411,327 | 5/1995 | Norton | 312/221 |
| 5,417,490 | 5/1995 | Hobbs et al. | 312/334.32 X |

FOREIGN PATENT DOCUMENTS

| | | | |
|---|---|---|---|
| 3633256 | 3/1988 | Germany | 312/221 |
| 2095322 | 9/1982 | United Kingdom | 312/221 |

*Primary Examiner*—Peter M. Cuomo
*Assistant Examiner*—James O. Hansen
*Attorney, Agent, or Firm*—Brooks & Kushman P.C.

[57] ABSTRACT

A multi-drawer cabinet having a cabinet housing and a plurality of drawers disposed one above the other in the housing and a slide mechanism slidably mounting each of the drawers in the housing for slidable movement between an open position extending outwardly from the housing and a closed position received entirely within the housing includes a drawer lock-out mechanism which binds the slide mechanisms of the closed drawers against slidable movement preventing a closed drawer from being opened when any of the other drawers is open.

19 Claims, 7 Drawing Sheets

Fig. 1
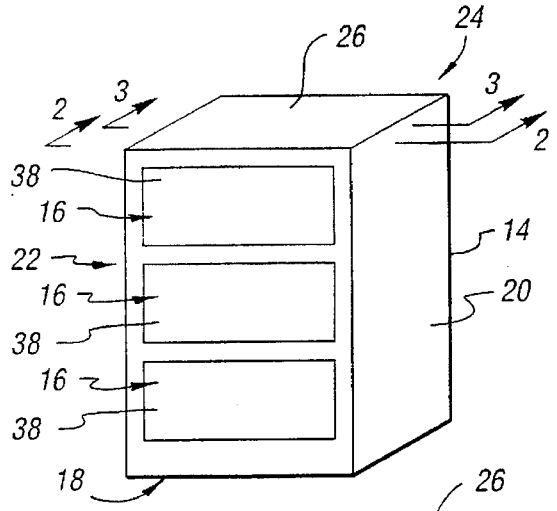
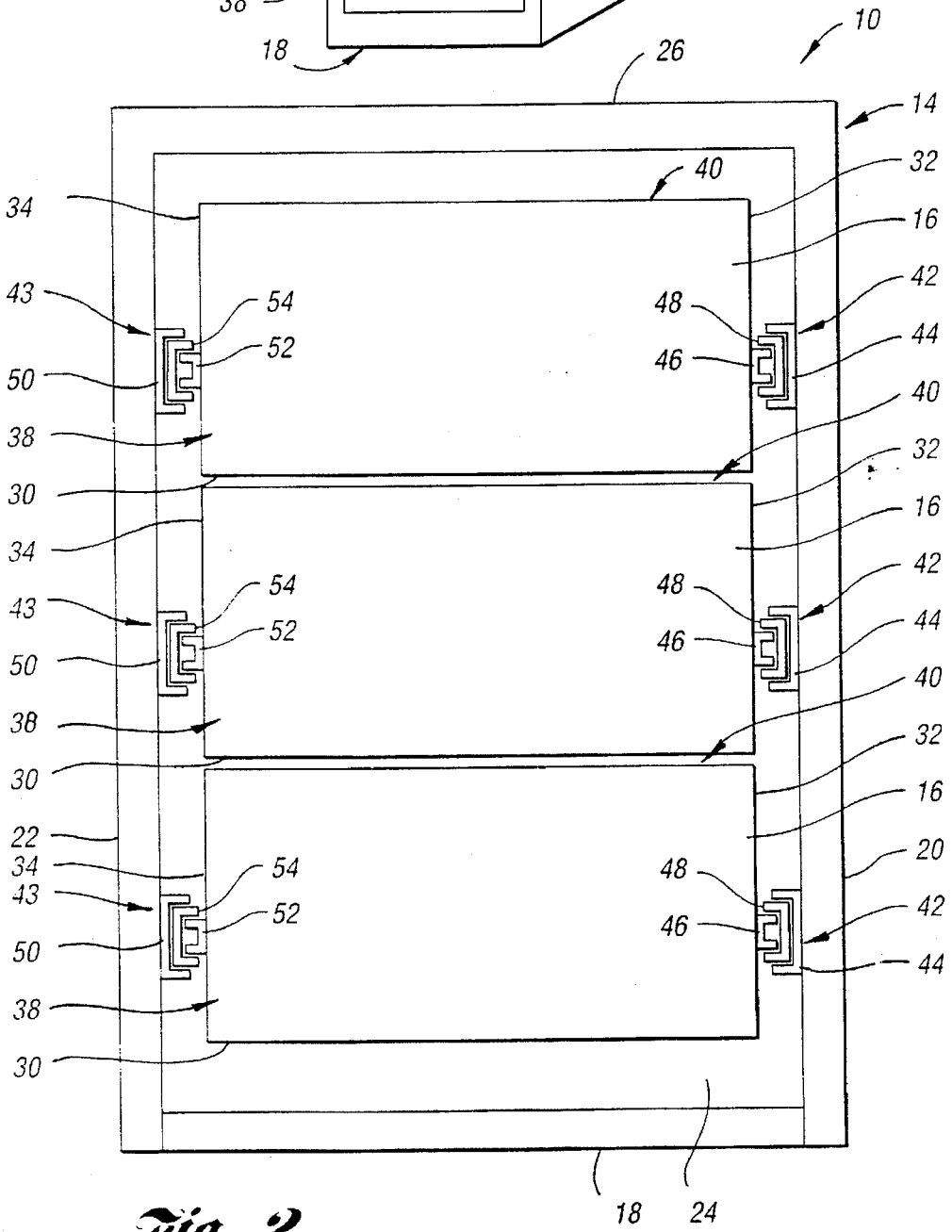
Fig. 2

Fig. 3
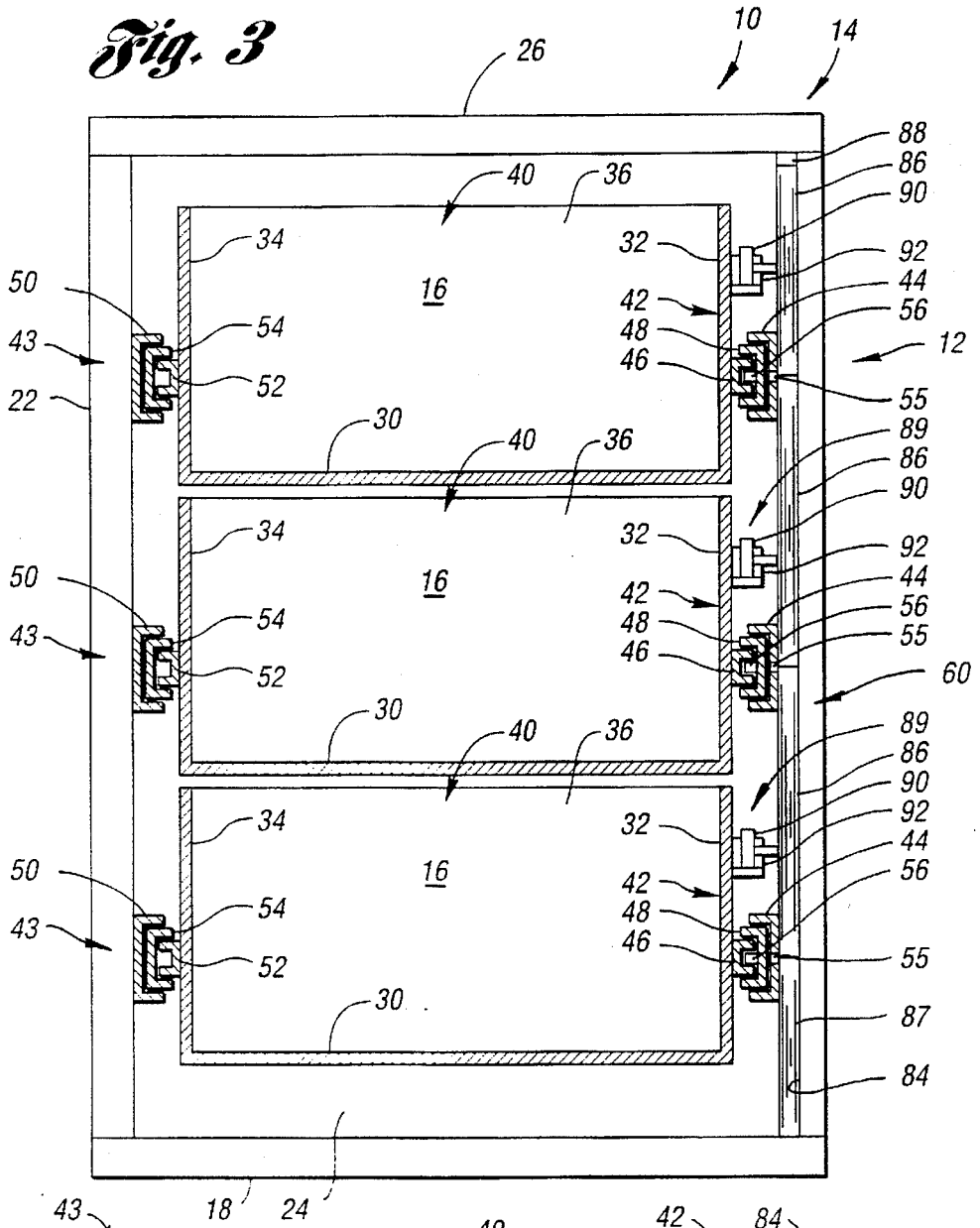
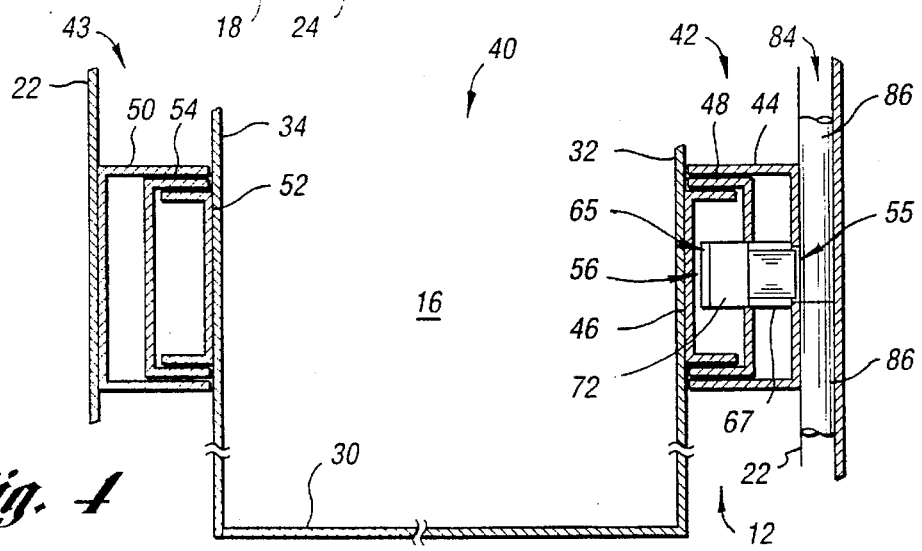
Fig. 4

MULTI-DRAWER CABINET HAVING A DRAWER LOCK-OUT MECHANISM

BACKGROUND OF THE INVENTION

The present invention relates to multi-drawer cabinets, and more particularly to multi-drawer cabinets which include drawer lock-out mechanisms which prevent any closed drawer from being opened when any of the other drawers is open.

BACKGROUND ART

Multi-drawer cabinets which have drawer lock-out mechanisms are known, per se. Such multi-drawer cabinets are used in business establishments for storing files and the like.

However, the lock-out mechanisms for multi-drawer cabinets often are relatively complicated and function independently of the drawer slide mechanisms which slidably support the drawers in the cabinet housing.

SUMMARY OF THE INVENTION

The present invention provides a multi-drawer cabinet having a drawer lock-out mechanism which functions with the drawer slide mechanisms to prevent any closed drawer from being opened when any other drawer is already open.

More particularly, the present invention provides a multi-drawer cabinet having a cabinet housing comprising a first side wall, a second side wall spaced from and parallel to the first side wall and an open front, a plurality of drawers disposed one above the other in the cabinet housing, each drawer comprising a bottom, a first side wall, and a second side wall spaced from and parallel to the first side wall, a slide mechanism slidably mounting each of the drawers in the cabinet housing for individual slidable movement between an open position extending outwardly through the open front of the cabinet and a closed position received entirely within the cabinet housing, and a drawer lock-out mechanism operatively associated with the drawers and the slide mechanisms for binding the slide mechanism of the closed drawers against slidable movement when any other of the drawers is open.

BRIEF DESCRIPTION OF THE DRAWINGS

A better understanding of the present invention will be had upon reference to the following description in conjunction with the accompanying drawings, wherein like numerals refer to like parts throughout the several views and in which:

FIG. 1 is a perspective view of a multi-drawer cabinet, including the drawer lock-out mechanism of the present invention;

FIG. 2 is a cross-sectional front view of the multi-drawer cabinet as seen in the direction of arrows 2—2 in FIG. 1;

FIG. 3 is a cross-sectional front view of the multi-drawer cabinet as seen in the direction of arrows 3—3 in FIG. 1;

FIG. 4 is an enlarged end view of the drawer slide mechanism of the multi-drawer cabinet;

DETAILED DESCRIPTION OF THE PREFERRED EMBODIMENTS

Figure 5:
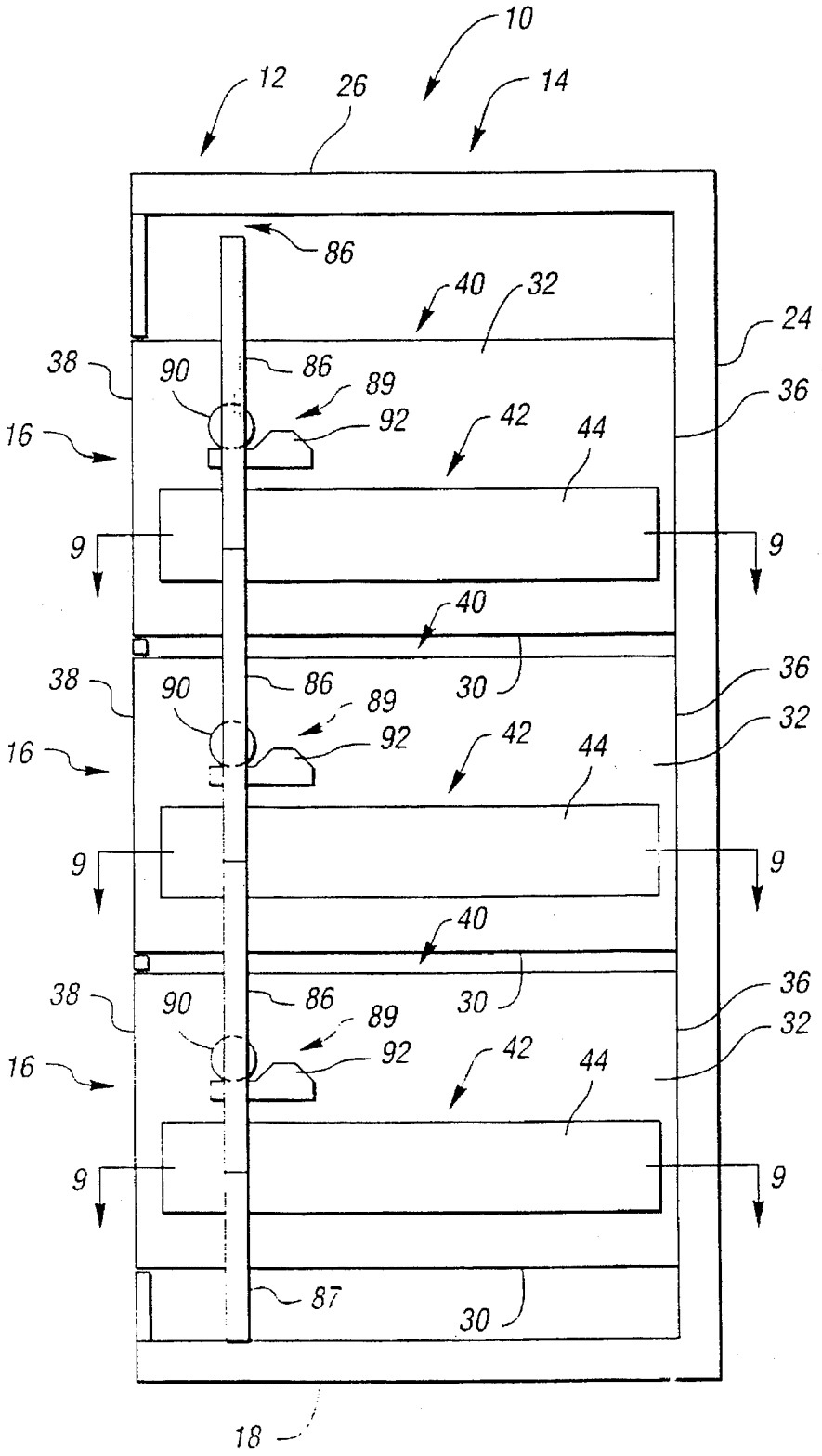
FIG. 5 is a cross-sectional side view of the multi-drawer cabinet with all of the drawers closed.

With reference to FIGS. 1 through 9, there is shown a multi-drawer cabinet apparatus, generally denoted as the number 10, incorporating a drawer lock-out mechanism, generally denoted as the numeral 12, of the present invention.

With continued reference to FIGS. 1 through 8, the multi-drawer cabinet apparatus 10 comprises a cabinet housing 14 containing a plurality of drawers 16. The cabinet housing 14 is shown as having a bottom 18, a first side wall 20, a second side wall 22, a back wall 24, a top 26, and an open front. The drawers 16 are shown as each having a bottom 30, a first side wall 32, a second side wall 34, a back wall 36, a front wall 38, and an open top 40. The drawers 16 are mounted one above the other in the cabinet housing 14 with the first drawer side wall 32 adjacent the first cabinet housing side wall 20, the second drawer side wall 34 adjacent the second cabinet housing side wall 22 and the drawer back wall 36 adjacent the housing cabinet back wall 24.

Each drawer 16 is slidably mounted in the cabinet housing 14 by a drawer slide mechanism for individual slidable movement between an open position extending outwardly through the open cabinet housing front and a closed position received entirely within the cabinet housing 14 (as can be best seen in FIGS. 5 through 8).

Now with reference to FIGS. 2 through 10, the drawer slide mechanism is of a known type and includes a pair of first and second telescoping bracket assemblies 42, 43, the first telescoping bracket assembly 42 slidably interconnecting the first drawer side wall 32 to the first cabinet housing side wall 20, and the second telescoping bracket assembly 43 slidably interconnecting the second drawer side wall 34 to the second cabinet housing side wall 22. The first telescoping bracket assembly 42 comprises a first horizontally disposed stationary elongated cabinet wall mounting bracket 44 attached to the cabinet housing first side wall 20, a first horizontally disposed elongated drawer mounting bracket 46 attached to the drawer first side wall 32 parallel to the first cabinet wall mounting bracket 44, and a first horizontally disposed elongated intermediate bracket 48 disposed between, parallel to, and interconnecting the first cabinet wall mounting bracket 44 and the first drawer mounting bracket 46. The first intermediate mounting bracket 48 is connected to the first cabinet wall mounting bracket 44 for longitudinal movement along the longitudinal axis of the first cabinet wall mounting bracket 44 as the drawer 16 is moved between closed and open positions, and is connected to the first drawer mounting bracket 46 providing for longitudinal movement of the first drawer mounting bracket 46 along the longitudinal axis of the first intermediate bracket 48 as the drawer 16 is moved between the closed and open positions. Similarly, the second telescoping bracket assembly 43 comprises a second horizontally disposed stationary elongated cabinet wall mounting bracket 50 attached to the cabinet housing second side wall 22, a second horizontally disposed elongated drawer mounting bracket 52 attached to the drawer second side wall 34 parallel to the second cabinet wall mounting bracket 50, and a second horizontally disposed elongated intermediate bracket 54 disposed between, parallel to, and interconnecting the second cabinet wall mounting bracket 50 and the second drawer mounting bracket 52. The second intermediate mounting bracket 54 is connected to the second cabinet wall mounting bracket 50 for longitudinal movement along the longitudinal axis of the second cabinet wall mounting bracket 50 as the drawer 16 is moved between the closed and open positions, and is connected to the second drawer mounting bracket 52 providing for longitudinal movement of the second drawer mounting bracket 52 along the longitudinal axis of the second intermediate bracket 54 as the drawer is moved between the closed and open positions.

Now with reference to FIGS. 3 through 10, there is shown the drawer lock-out mechanism 12 of the present invention which provides for the movement of only one drawer 16 at a time from the closed position to the open position. That is, when one drawer 16 is in the open position, all of the other drawers 16 are locked in the closed position. The drawer lock-out mechanism 12 comprises an aperture 55 (see FIGS. 9 and 10) in the first cabinet wall mounting bracket 44 at a predetermined location along the longitudinal axis of the bracket 44, pin means 56 associated with the first cabinet wall mounting bracket 44 of each first telescoping bracket assembly 42, pin activating means 58 associated with the first intermediate bracket 48 of each first drawer slide assembly 42 to coact with the pin means 56, movable locking rod means 60 (see FIG. 3) at the first side wall 20 of the cabinet housing 14 in alignment with the aperture 55 and rod moving means 89 operatively interconnecting the movable locking rod means 60 and the drawers 16. As one of the drawers 16 is moved to the open position, the rod moving means 89 of the drawer being moved coacts with the movable locking rod means 60 moving the locking rod means 60 from an initial unlatched position (see FIG. 5) with a clearance space 88 thereabove to a latched position (see FIGS. 6, 7, and 8) into the clearance space 88 and creating a pin-receiving space therein adjacent the pin means 56 of the drawer 16 being moved. Concurrently, with the movement of the locking rod means 60, the pin-activating means 58 of the first intermediate bracket 48 of the opening drawer 16 moves the pin means 56 from a first or locking position (see FIG. 9) to a second or unlocked position (see FIG. 10) into the pin-receiving space of the locking rod means 60. When the locking rod means 60 is moved to the latched position with the pin means 56 of the moving drawer 16 the pin-receiving space created in the locking rod means 60, the pin means 56 of the other of closed drawers 16 are blocked by the locking rod means 60 from moving from the locking position (see FIG. 9) to the unlocked position (see FIG. 10) because the locking rod means 60 has been moved into the clearance space 88 by the moving drawer 16 preventing any further movement of the locking rod means 60 by the rod-moving means 89 of the closed drawers 16 and, therefore, preventing any pin-receiving space from being created adjacent the pin means 56 of the closed drawers 16.

The following discussion of the pin means 56 and pin activating means 58 will be in the singular sense speaking to only the first telescoping bracket assembly 42 of the drawer slide mechanism of one drawer 16, it being understood and clearly shown in the drawings that the description applies equally to the first telescoping bracket assembly of each drawer slide assembly of each of the drawers 16. As can be best seen in FIGS. 9 and 10, the pin means 56 comprises a cam follower head 65 with a pin 66 mounted on the cam follower head 65 and extending in alignment with the aperture 55. The locking pin means 56 is mounted to the side of the mounting bracket 44 which interfaces with the first intermediate bracket 48 for movement between the unlocked position whereat the pin 66 protrudes through the aperture 55 in the first cabinet wall mounting bracket 44 (see FIG. 10) and the locking position whereat the pin 66 is retracted from the aperture 55 in the first cabinet wall mounting bracket 44 (see FIG. 9). As shown, the movable locking pin means 56 is movably mounted to the cabinet wall mounting bracket 44 for pivotal movement by a hinge 67. The hinge 67 comprises, for example, a hinge joint 68. The cam follower head 65 includes a first cam follower (or first activating) surface 70 and a second cam follower (or second activating) surface 72, which coacts with the pin activating cam means 58 of the first intermediate bracket 48 as the first intermediate bracket 48 moves with the drawer 16 between opened and closed positions. As the drawer 16 moves from the closed position (see FIGS. 5–9) to the open position (see FIGS. 5–8 and 10), the pin activating cam means 58 coacts with the first activating surface 70 of the locking pin means 56 to push the pin means 56 toward the first cabinet wall mounting bracket, thereby moving it about the hinge joint 68 and forcing the pin 66 through the aperture 55 to the unlocked position. As the drawer 16 moves from the open position to the closed position, the pin activating cam means 58 coacts with the second activating surface 72 of the locking pin means 56 to pull the locking pin means 56 away from the first cabinet wall mounting bracket 44, thereby moving it about the hinge joint 68 in the other direction and pulling the pin 66 back out of the aperture 55 to the locking position. Toward this objective, the pin activating means 58 comprises a first cam surface 74 formed on the first intermediate bracket 48 and a second cam surface 76 also formed on the first intermediate bracket 48 spaced from the first cam surface 74 longitudinally of the first intermediate bracket 48. When the drawer 16 is in the closed position (see FIG. 9), the cam follower head 65 projects into the space between the first cam surface 74 and the second cam surface 76. The first cam surface 74 contacts the first cam follower surface 70 of the locking pin means 56 as the first intermediate bracket 48 moves with the drawer 16 from the closed toward the open position forcing the pin 66 through the aperture 55 in the first cabinet wall mounting bracket 44 and into engagement with the locking rod means 60. The second cam surface 76 contacts the second cam follower surface 72 of the locking pin means 56 as the first intermediate bracket 48 moves with the drawer 16 from the open toward the closed position pulling the pin 66 back out of the aperture 55 and out of engagement with the locking rod means 60. As shown best in FIGS. 9 and 10, the first cam surface 70 is a first ramp surface formed at the top side of the cam follower head 65, and the second cam surface 72 is a second ramp surface formed at the bottom side of the cam follower head 65. The pin 66 is located generally between the first ramp surface 70 and the second ramp surface 72. The first intermediate bracket 48 is formed with an opening 78. The first cam surface 74 (which coacts with the first cam follower surface 70 of the pin means 56 to force the pin 66 through the aperture 55 in the first cabinet wall mounting bracket 44) is defined by one end edge of the opening 78. The second cam surface 76 (which coacts with the second cam follower surface 72 of the pin means 56 to pull the pin 66 out of the aperture 55 to a retracted position) is a cantilevered flange at the opposite end of the opening 78 from the edge defining the first cam surface 74 and extends from the intermediate bracket 48 toward the first cabinet wall mounting bracket 44.

Figure 6:
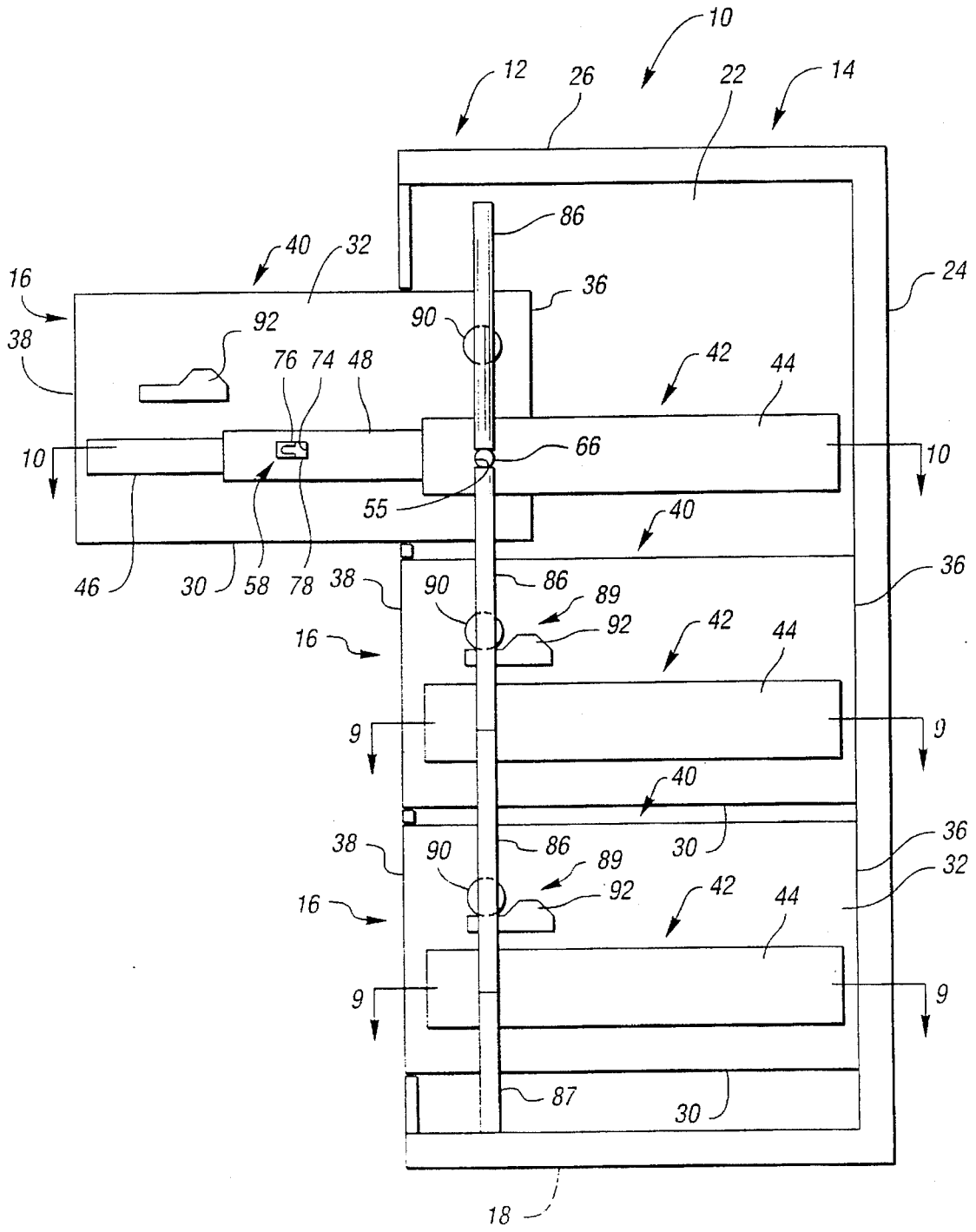
FIG. 6 is a cross-sectional side view of the multi-drawer cabinet with the top drawer open.
Figure 7:
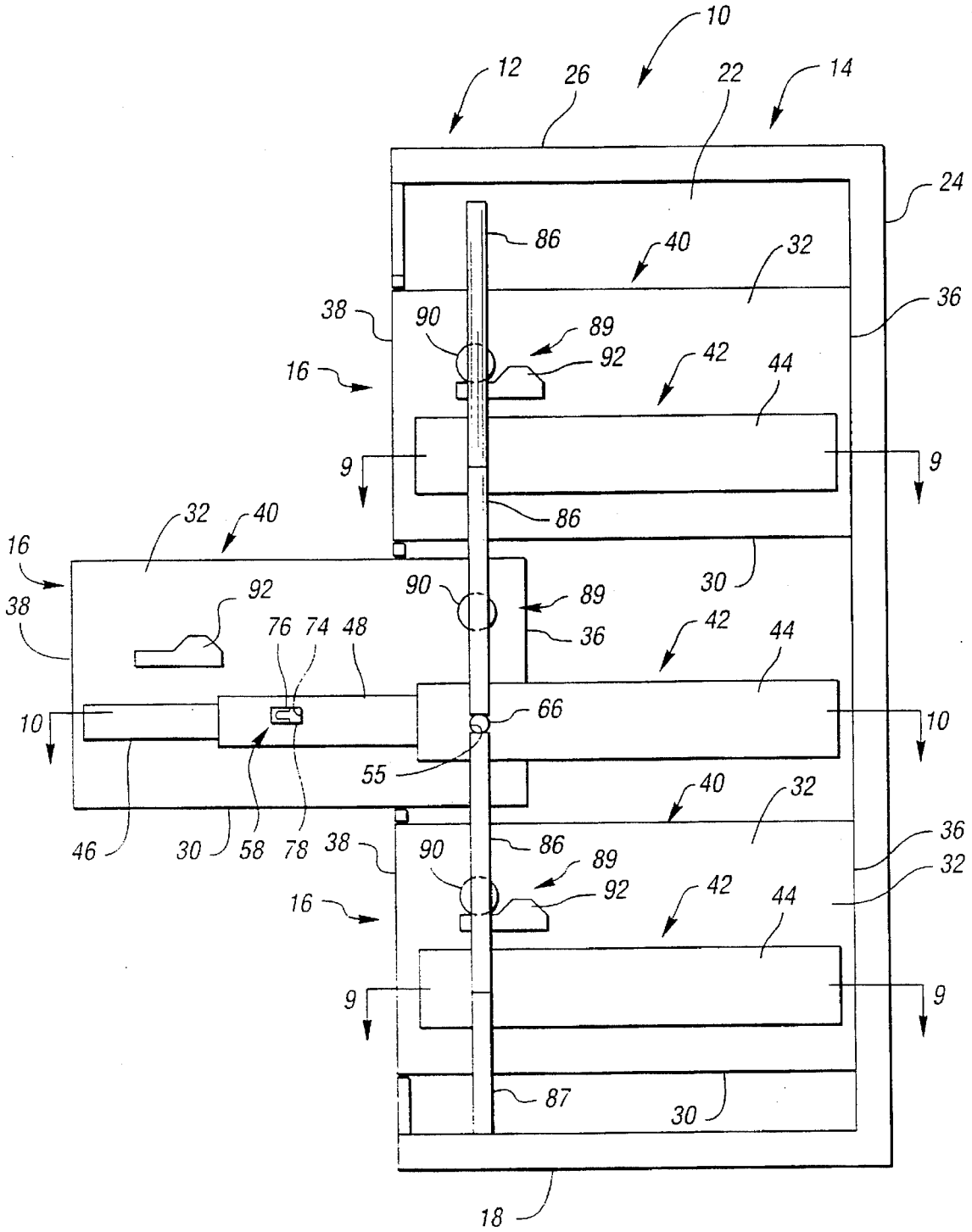
FIG. 7 is a cross-sectional side view of the multi-drawer cabinet with the middle drawer open.
Figure 8:
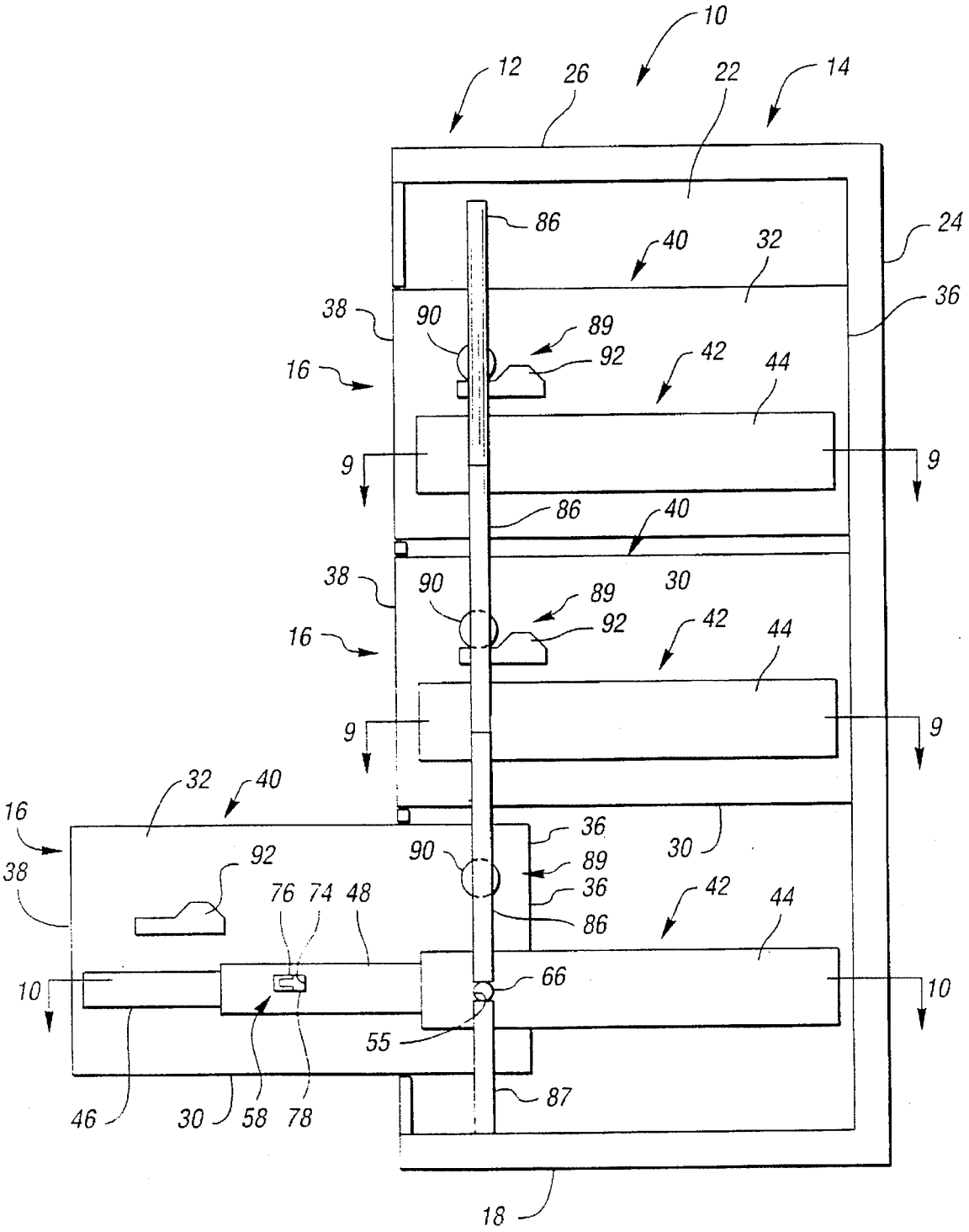
FIG. 8 is a cross-sectional side view of the multi-drawer cabinet with the bottom drawer open.

As can be best seen in FIGS. 6, 7, and 8, the ramp defining the second cam surface 76 is formed with a notch which receives the pin 66 in the retracted or unlocked position.

The locking rod means 60 comprises a locking rod channel 84 formed at the interior surface of the first side wall 20 of the cabinet housing 14. The locking rod channel 84 is vertically oriented and extends essentially the height of the cabinet housing 14. Therefore, the locking rod channel 84 is perpendicular to and extends past all of the first cabinet wall mounting brackets 44. Further, the locking rod channel 84 is in alignment with the apertures 55 in the first cabinet wall mounting brackets 44. The locking rod means 60 further comprises a plurality of locking rods 86 received in the locking rod channel 84 for longitudinal movement therein. The number of locking rods 86 is equal to the number of drawers 16, for example as shown, there are three drawers 16 and three locking rods 86. When all of the drawers 16 are closed, the locking rods 86 are disposed in mutual longitudinally coaxial alignment and end-to-end interfacing abutment with each abutting rod interface being in alignment with the bottom edge of the aperture 55 in a different one of the first cabinet wall mounting brackets 44. Therefore, the length of each locking rod 86 corresponds to the vertical distance between apertures 55 in adjacent first cabinet wall mounting brackets 44. Also, when the bottom drawer 16 is in the closed position, the bottom end of the lowest locking rod 86 is in abutment with a support shown as a stationary support rod 87. The interface of the abutment is in alignment with the bottom edge of the aperture 55 in the first cabinet wall mounting bracket 44 of the lowest of the bottom drawer slide mechanism 42. The locking rods 86 move upwardly to a latched position and downwardly to an unlatched position along the longitudinal axis of the locking rod channel 84. As can be best seen in FIGS. 3 and 5, when all of the drawers 16 are closed, there is a clearance space 88 above the top end of the top locking rod 86.

With reference to FIGS. 3 through 8, each locking rod 86 also includes rod moving means, generally denoted as the numeral 89, for moving the locking rods 86 upwardly in the locking rod channel 84 as a drawer 16 is moved from the closed position to the open position. The rod moving means 89 comprises a cam follower 90 attached to each of the locking rods 86 between the ends of the rod 86 adjacent to the first side wall 32 of the drawer 16, and a cam 92 attached to the exterior surface of the first side wall 32 of the drawer 16 for movement with the drawer 16 as it moves from the closed position to the open position. As shown, the cam follower 90 is a pin or roller attached to the locking rod 86 and the cam 92 includes a ramp structure which contacts the under side of the pin or roller 90 as a drawer 16 moves toward the open position pushing the locking rod 86 associated with that cam follower 90 upwardly in the locking rod channel 84 into the clearance space 88 and creating a pin receiving space between the bottom end of that locking rod 86 and the top end of the next lower locking rod 86.

In operation, with all of the drawers 16 in the closed position (see FIGS. 5 and 9), all of the locking rods 86 are in the lowered position and in end-to-end abutment in the locking rod channel 84 with the clearance space 88 above the top end of the top one of the locking rods 86, and the pin 66 of each movable locking pin means 56 is in the retracted position retracted from the aperture 55 of the first cabinet wall mounting bracket 44. FIG. 6 illustrates the top drawer 16 being open and the other drawers 16 closed, FIG. 7 illustrates the middle drawer 16 being open and the other drawers 16 closed, and FIG. 8 illustrates the bottom drawer 16 open and the other drawers 16 closed. When any drawer 16 is moved from the closed position to the open position, the cam 92 on the first side wall 32 of that moving drawer 16 contacts the cam follower 90 on the adjacent locking rod 86 and moves that locking rod 86 upwardly in the channel 84 into the clearance space 88 creating a pin receiving space between the bottom end of that moved locking rod 86 and the top end of the next lower locking rod 86. Of course, as that locking rod 86 associated with the drawer 16 being moved to the open position moves upwardly in the channel 84, it also pushes all of the locking rods 86 above it upwardly in the locking rod channel 84.

Figure 9:
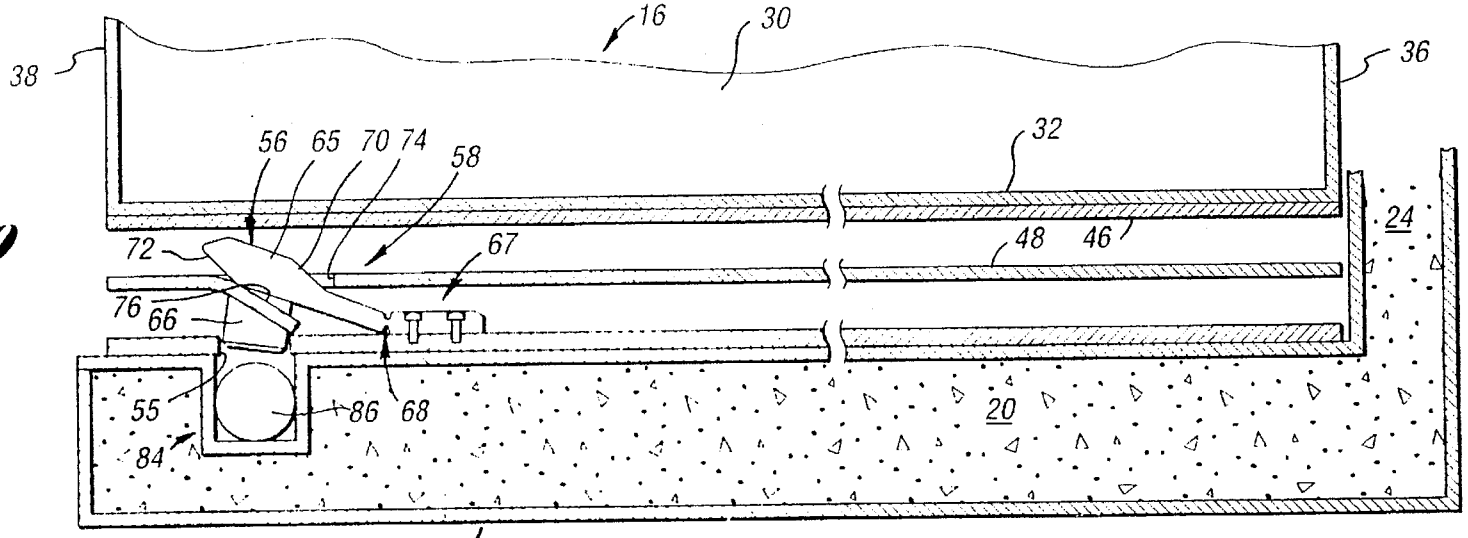
FIG. 9 is a cross-sectional longitudinal view of the drawer stop mechanism when a drawer is closed as seen in the direction of arrows 9—9 in FIGS. 5, 6, 7, and 8.
Figure 10:
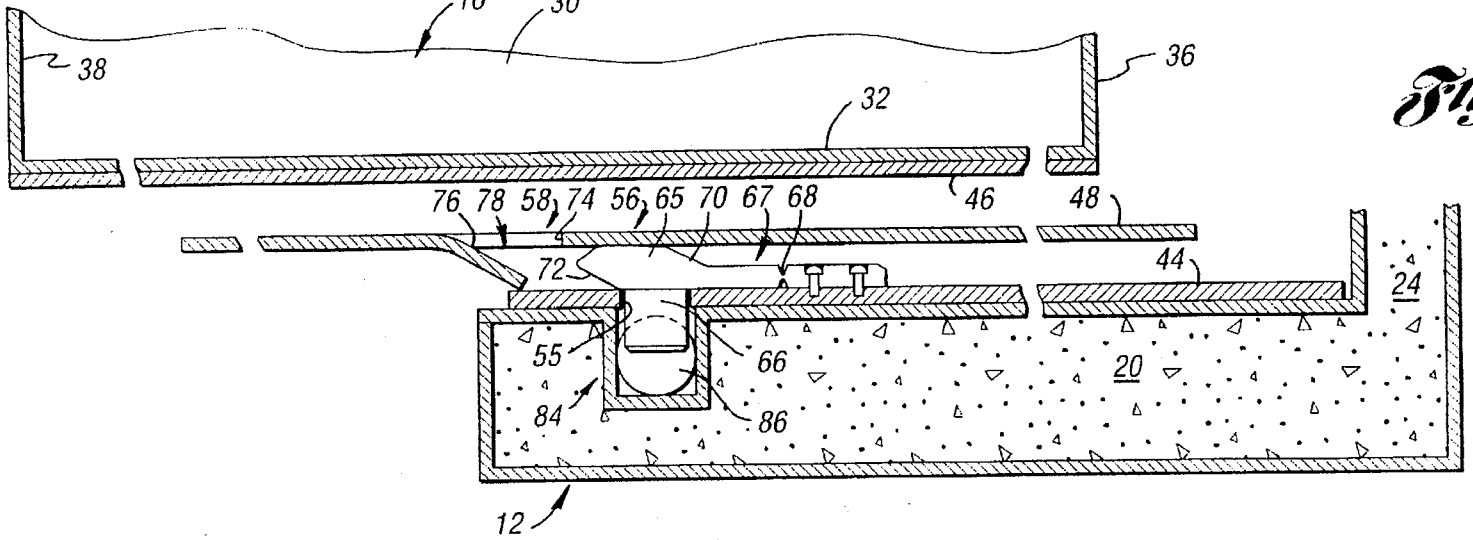
FIG. 10 is a cross-sectional longitudinal view of the drawer stop mechanism when a drawer is in the open position as seen in the direction of arrows 10—10 in FIGS. 6, 7, and 8.
Figure 6:
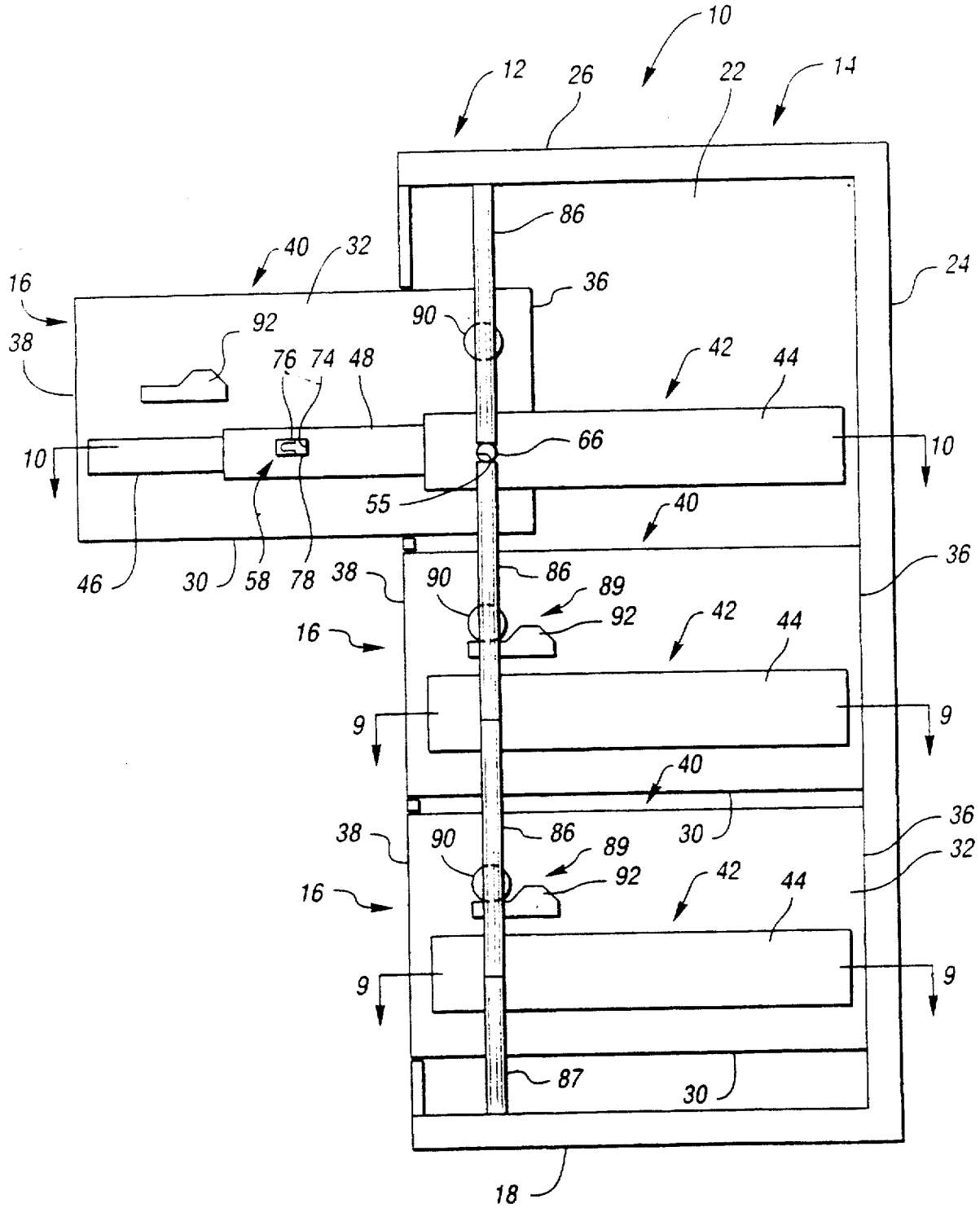
Figure 7:
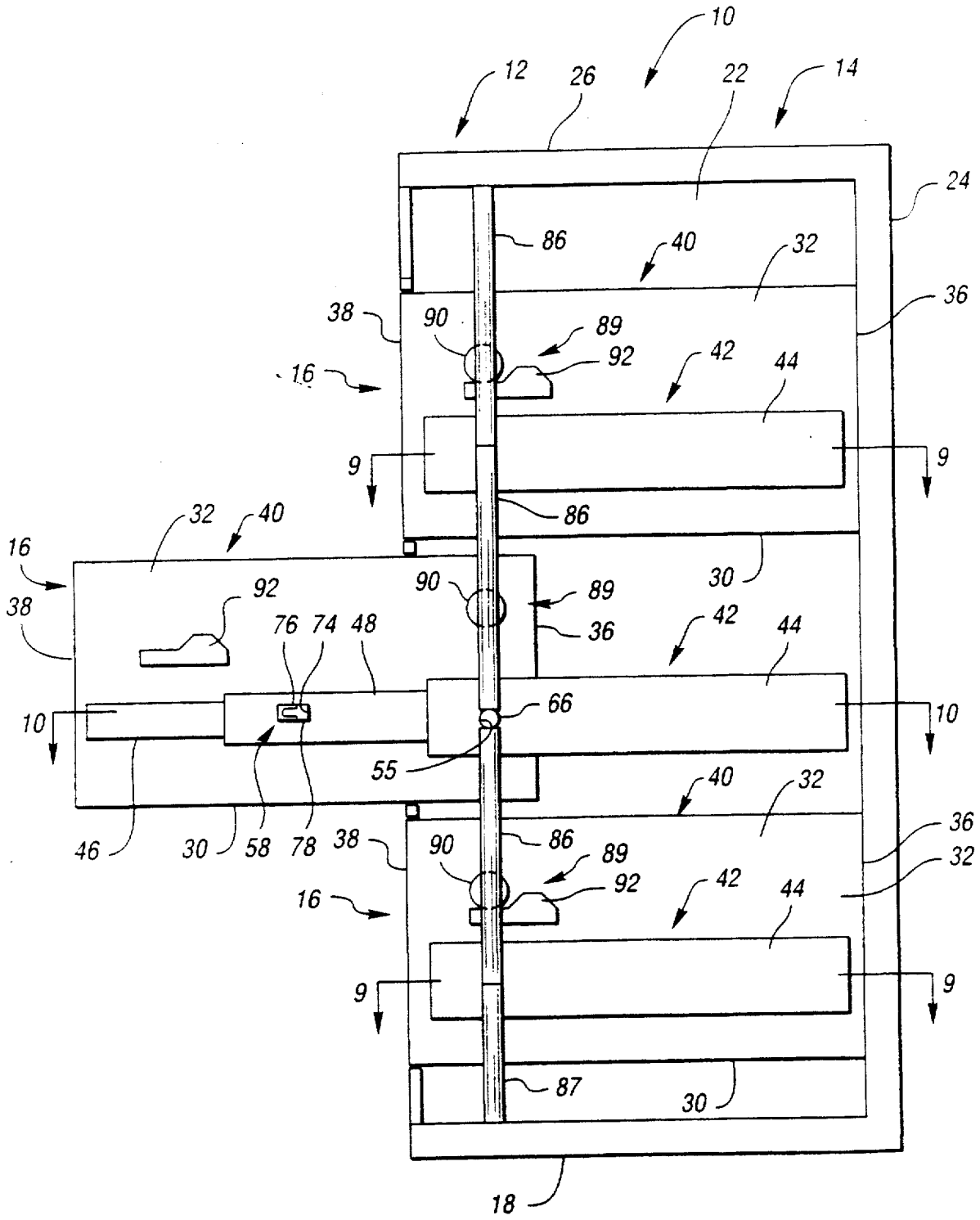
Figure 8:
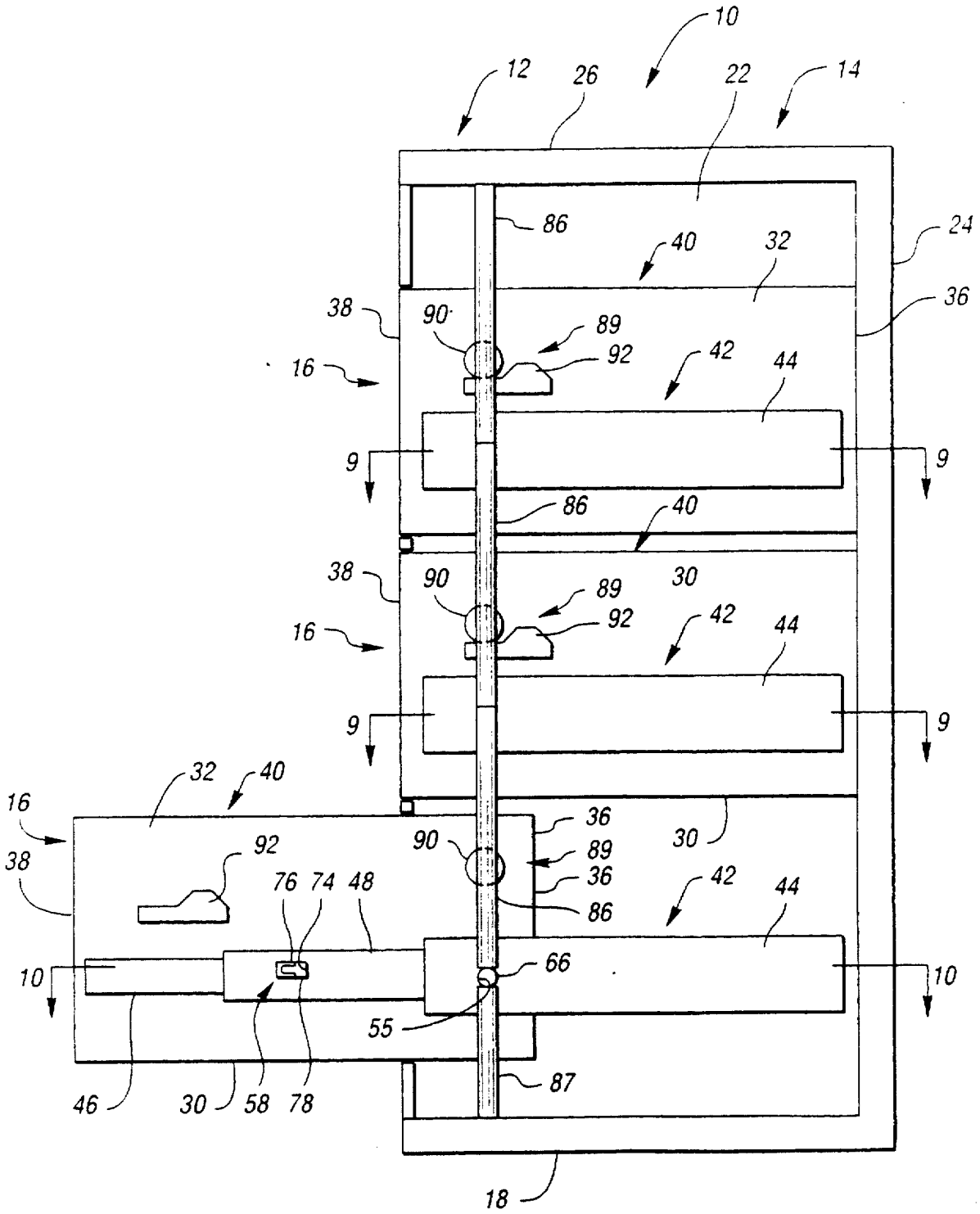

As shown in FIG. 6 and with reference to FIGS. 9 and 10, when the top drawer 16 is moved to the open position, only the top-most locking rod 86 associated with the top drawer 16 moves upwardly into the clearance space 88 due to the coaction of the cam 92 on the top drawer 16 with the cam follower 90 on the top-most rod 86 creating a pin receiving space between the bottom end of that top locking rod 86 and the top end of the next lower or middle locking rod 86 associated with the middle drawer 16, while all of the locking rods 86 associated with the other drawers (the middle and bottom drawers) remain stationary in end-to-end abutment. As the top drawer 16 is moved to the open position, the intermediate mounting bracket 48 moves with the top drawer 16 outwardly of the cabinet housing 14 and the first cam surface 74 coacts with the first cam follower surface 70 pushing the pin 66 through the aperture 55 in the first cabinet wall mounting bracket 44 to the unlocked position projecting into the channel 84, and projecting into the pin-receiving space (see FIG. 10) caging the locking rods 86 of the lower drawers 16 (middle and bottom drawers) against movement in the channel 84 between the pin 66 of the top drawer movable locking pin means 56 and the support rod 87. Therefore, if one were to try to pull any of the closed drawers (i.e. the middle drawer or the bottom drawer) to the open position, the first cam surface 74 on the first intermediate bracket 48 of the first telescoping bracket assembly 42 will move into contact with the cam follower surface 70 of the cam follower head 65 of the locking pin means 56 projecting into the space between the first cam surface 74 and the second cam surface 76 pushing the pin 66 into the aperture 55. However, because the locking rod 86 associated with the closed drawer is caged against movement, a pin receiving space cannot be formed between adjacent locking rods 86, and, therefore, the pin 66 of the locking pin means 56 cannot move into the channel 84 from the locking position (FIG. 9) to the unlocked position (FIG. 10). Therefore, the first telescoping bracket assembly 42 binds due to the interference of the first cam surface 74 and the cam follower 70 preventing the closed drawer from being pulled to the open position. Additionally, the cam 92 on that closed drawer would contact the cam follower 90 on the adjacent or associated locking rod 86, but because that locking rod 86 is caged against movement, as discussed above, the cam follower 90 functions as a further or secondary stop to the movement of the drawer to the open position.

As shown in FIG. 7, when the middle drawer 16 is moved to the open position, the middle locking rod 86 associated with the middle drawer 16 moves upwardly due to the coaction of the cam 92 on the middle drawer 16 with the cam follower 90 on the middle rod 86 creating a pin receiving space between the bottom end of the middle rod 86 and the top end of the next lower or bottom locking rod 86. As the middle locking rod 86 moves upwardly, it pushes the top locking rod 86 above it upwardly into the clearance space 88, while the bottom locking rod 86 associated with the bottom drawer 16 remains stationary in end-to-end abutment with the support rod 87. As the middle drawer 16 is moved to the open position, the intermediate mounting bracket 48 moves with the middle drawer 16 outwardly of the cabinet housing 14 and the first cam surface 74 coacts with the first cam follower surface 70 pushing the pin 66 through the aperture 55 in the first cabinet wall mounting bracket 44 to the locked position into the pin receiving space (see FIG. 10) caging the locking rod 86 of the bottom drawer against movement in the channel between the pin 66 of the middle drawer movable locking pin means 56 and the support rod 87. Also, because the top locking rod 86 has moved upwardly in the channel 84, it is caged against movement in the channel 84 between the top of the clearance space 88 and the top end of the locking rod 86 of the middle drawer 16. Therefore, if one were to try to pull any of the closed drawer (i.e. the top drawer or the bottom drawer) to the open position, the first cam surface 74 on the first intermediate bracket 48 of the first telescoping bracket assembly 42 will move into contact with the cam follower surface 70 of the cam follower head 65 of the locking pin means 56 projecting into the space between the first cam surface 74 and the second cam surface 76 pushing the pin 66 into the aperture 55. However, because the locking rod 86 associated with the closed drawer is caged against movement, a pin receiving space cannot be formed between adjacent locking rods 86 and, therefore, the pin 66 of the locking pin means 56 cannot move into the channel 84 from the locking position (FIG. 9) to the unlocked position (FIG. 10). Therefore, the first telescoping bracket assembly 42 binds due to the interference of the first cam surface 74 and the cam follower 70 preventing the closed drawer from being pulled to the open position. Additionally, the cam 92 on that closed drawer would contact the cam follower 90 on the adjacent or associated locking rod 86, but because that locking rod 86 is caged against movement, as discussed above, the cam follower 92 functions as a further or secondary stop to the movement of the drawer to the open position.

As shown in FIG. 8, when the bottom drawer 16 is moved to the open position, the bottom locking rod 86 associated with the bottom drawer 16 moves upwardly due to the coaction of the cam 92 on the bottom drawer 16 with the cam follower 90 on the bottom rod 86 creating a pin receiving space between the bottom end of the bottom rod 86 and the top end of the support rod 87. As the bottom locking rod 86 moves upwardly, it pushes all of the locking rods 86 above it, i.e. the middle and top locking rods 86, upwardly into the clearance space 88. As the bottom drawer 16 is moved toward the open position, the intermediate mounting bracket 48 moves with the bottom drawer outwardly of the cabinet housing 14 and the first cam surface 74 coacts with the first cam follower surface 70 pushing the pin 66 through the aperture 55 in the first cabinet wall mounting bracket 44 to the unlocked position into the pin receiving space (see FIG. 10) caging the locking rod 86 of the middle drawer and the locking rod 86 of the top drawer 16 against movement between the pin 66 of the bottom drawer movable locking pin means 56 and the top of the clearance space 88. Therefore, if one were to try to pull any of the closed drawers (i.e. the top drawer or the middle drawer) to the open position, the first cam surface 74 on the first intermediate bracket 48 of the first telescoping bracket assembly 42 will move into contact with the cam follower surface 70 of the cam follower head 65 of the locking pin means 56 projecting into the space between the first cam surface 74 and the second cam surface 76 pushing the pin 66 into the aperture 55. However, because the locking rod 86 associated with the closed drawer is caged against movement, a pin receiving space cannot be formed between adjacent locking rods 86 and, therefore, the pin 66 of the locking pin device 63 cannot move into the channel 84 from the locking position (FIG. 9) to the unlocked position (FIG. 10). Therefore, the first telescoping bracket assembly 42 binds due to the interference of the first cam surface 74 and the cam follower 70 preventing the closed drawer from being pulled to the open position. Additionally, the cam 92 on that closed drawer would contact the cam follower 90 the adjacent or associated locking rod 86, but because that locking rod 86 is caged against movement, as discussed above, the cam follower 92 functions as a further or secondary stop to the movement of the drawer to the open position.

When an open drawer 16 has moved back from the open position to the closed position, the second cam surface 76 of the first intermediate bracket 48 of the first telescoping bracket assembly 42 coacts with the second cam follower surface 72 of the locking pin means 56 pulling the pin 66 out of the channel 84, that is out of the pin receiving space between the bottom end of the rod 46 associated with the moving drawer and the top end of the next lowest locking rod 46 and back out of the aperture 55 of the first cabinet wall mounting bracket 44, to the retracted or unlocked position. This allows the locking rod 86 associated with the moving drawer 16 to drop down in the channel 84 back into end-to-end abutment with the next lowest locking rod 86 so that another drawer 16 can now be moved to the open position.

The foregoing detailed description is given primarily for clearness of understanding and no unnecessary limitations are to be understood therefrom for modifications will become obvious to those skilled in the art upon reading this disclosure and may be made without departing from the scope of the inventions or scope of the appended claims.

We claim:

1. A multi-drawer cabinet, comprising:

a. a cabinet housing comprising a first side wall, a second side wall spaced from and parallel to the first side wall and an open front;

b. a plurality of drawers disposed one above the other in the cabinet housing, each drawer comprising a bottom, a first side wall, and a second side wall spaced from and parallel to the first side wall;

c. slide mechanisms slidably mounting drawers in the cabinet housing for individual slidable movement between an open position extending outwardly through the open front of the cabinet and a closed position received within the cabinet housing;

d. a drawer lock-out mechanism operatively associated with the slide mechanisms for binding the slide mechanisms of the closed drawers against slidable movement when any one of the other drawers is open, the drawer lock-out mechanism further comprising movable locking rod means at the first wall of the cabinet housing adjacent the slide mechanisms of all of the drawers and extending past the slide mechanisms, rod moving means operatively interconnecting the movable locking rod means and the drawers for moving the locking rod means as a first drawer is moved from the closed position to the open position and creating a pin receiving space in the locking rod means adjacent only the slide mechanism of the first drawer being moved to the open position and pin means associated with the slide mechanisms for movement into a pin receiving space in the locking rod means, the pin means comprising a pin movably mounted to the drawer slide mechanism in alignment with an aperture in the drawer slide mechanism for movement between an unlocked position protruding through the aperture and into a pin receiving space formed in the locking rod means, and a locking position retracted from the aperture in the drawer slide mechanism; and e. pin activating means associated with the drawer slide mechanism for coacting with the pin means as the drawer is moved from the closed position toward the open position;

i. wherein the pin activating means associated with the slide mechanism of the first drawer being moved from the closed position to the open position moves the pin of the pin means through the aperture in the drawer slide mechanism and into the pin receiving space in the locking rod means to the unlocked position, and, ii. wherein the pin activating means associated with the slide mechanisms of the closed drawers abuts against the pin means in the locking position binding the slide mechanisms of the closed drawers against movement.

2. The multi-drawer cabinet of claim 1, wherein the movable locking rod means comprises:

a. a locking rod channel at the interior surface of the first side wall of the cabinet housing extending perpendicular to and past all of the drawer slide mechanisms;

b. a plurality of locking rods received in the locking rod channel for longitudinal movement therein upwardly and downwardly, and when all of the drawers are closed, the locking rods are disposed in mutual longitudinally coaxial end-to-end interfacing abutment, and each abutting rod interface being in alignment with the pin means of the slide mechanism of a different one of the drawers.

3. The multi-drawer cabinet of claim 2, further comprising means defining a locking rod clearance space above the top end of the top-most locking rod when all of the drawers are closed for receiving the top end of the top-most locking rod when any of the locking rods are moved upwardly in the locking rod channel as a drawer is moved from the closed position toward the open position.

4. The multi-drawer cabinet of claim 2, wherein the rod moving means comprises:

a. a cam follower attached to each of the locking rods adjacent each drawer; and, b. a cam attached to each of the drawers for contacting the adjacent cam follower as that drawer is moved from the closed to the open position, thereby moving the locking rod upwardly in the locking rod channel creating a pin means receiving space between the bottom end of that locking rod and the top end of the next lower locking rod for receiving the pin means of the drawer being moved.

5. The multi-drawer cabinet of claim 1, wherein the pin activating means further coacts with the pin means associated with the drawer slide mechanisms of an open drawer as the open drawer is moved to the closed position to retract the pin of the pin means from the pin receiving space in the locking rod means to the locking position.

6. The multi-drawer cabinet of claim 1, wherein:

a. the pin means further comprises a cam follower structurally associated with the pin; and b. the pin activating means comprises a first cam surface on the drawer slide mechanism for movement therewith for contacting cam follower of the pin means as the drawer moves from the closed position toward the open position, thereby pushing the pin of the pin means through the aperture in the drawer slide mechanism to the unlocked position, and a second cam surface on the drawer slide mechanism for movement therewith for contacting the cam follower of the pin means as the drawer moves from the open position toward the closed position thereby pulling the pin of the pin means out of the aperture in the drawer slide mechanism to the locking position.

7. The multi-drawer cabinet of claim 6, wherein the cam follower of the pin means comprises:

a. a first cam follower surface which is contacted by the first cam surface of the pin activating means as the drawer is moved from the closed position toward the open position; and, b. a second cam follower surface which is contacted by the second cam surface of the pin activating means as the drawer is moved from the open position toward the closed position.

8. The multi-drawer cabinet of claim 6, wherein the first cam surface on the drawer slide mechanism and the second cam surface on the drawer slide mechanism are spaced apart from each other longitudinally of the drawer slide mechanism, and the cam follower of the pin means is disposed in the space between the first cam surface and the second cam surface when the drawer is closed.

9. The multi-drawer cabinet of claim 1, wherein the slide mechanism slidably mounting each of the drawers in the cabinet comprises:

a. a first telescoping bracket assembly comprising:

i. a first horizontally disposed stationary elongated cabinet wall mounting bracket attached to the cabinet housing first side wall;

ii. a first horizontally disposed elongated drawer mounting bracket attached to the drawer first side wall; and, iii. a first horizontally disposed elongated intermediate bracket disposed between and interconnecting the first cabinet wall mounting bracket and the first drawer mounting bracket, the first intermediate mounting bracket is connected to the first cabinet wall mounting bracket for longitudinal movement along the longitudinal axis of the first cabinet wall mounting bracket as the drawer is moved between the closed and open positions, and is connected to the first drawer mounting bracket providing for longitudinal movement of the first drawer mounting bracket along the longitudinal axis of the first intermediate bracket as the drawer is moved between the closed and open position;

b. a second telescoping bracket assembly comprising:

i. a second horizontally disposed stationary elongated cabinet wall mounting bracket attached to the cabinet housing second side wall;

ii. a second horizontally disposed elongated drawer mounting bracket attached to the drawer second side wall; and, iii. a second horizontally disposed elongated intermediate bracket disposed between and interconnecting the second cabinet wall mounting bracket and the second drawer mounting bracket, the second intermediate mounting bracket is connected to the second cabinet wall mounting bracket for longitudinal movement along the longitudinal axis of the second cabinet wall mounting bracket as the drawer is moved between the closed and open positions, and is connected to the second drawer mounting bracket providing for longitudinal movement of the second drawer mounting bracket along the longitudinal axis of the second intermediate bracket as the drawer is moved between the closed and open positions.

10. The multi-drawer cabinet of claim 9, wherein the drawer lock-out mechanism is operatively associated with the first intermediate bracket, and the first cabinet wall mounting bracket for binding the first intermediate bracket against slidable movement relative to the first cabinet wall mounting bracket.

11. The multi-drawer cabinet of claim 10, wherein the drawer lock-out mechanism further comprises:

a. movable locking rod means at the first wall of the cabinet housing adjacent the first cabinet wall mounting brackets of each of the slide mechanisms and extending perpendicularly past the first cabinet wall mounting brackets of each of the slide mechanisms;

b. rod moving means operatively interconnecting the movable locking rod means and the first side walls of the drawers for moving the locking rod means as a first drawer is moved from the closed position to the open position and creating a pin receiving space in the locking rod means adjacent only the first cabinet wall mounting bracket of the slide mechanism of the first drawer being moved; and, c. pin means mounted to the first cabinet wall mounting bracket of the slide mechanisms for movement into a pin receiving space in the locking rod means.

12. The multi-drawer cabinet of claim 11, wherein the movable locking rod means comprises:

a. a locking rod channel at the interior surface of the first side wall of the cabinet housing extending perpendicular to and past all of the first wall mounting brackets of the drawer slide mechanisms;

b. a plurality of locking rods received in the locking rod channel for longitudinal movement therein upwardly and downwardly, and when all of the drawers are closed, the locking rods are disposed in mutual longitudinally coaxial end-to-end interfacing abutment, and each abutting rod interface being in alignment with the pin means of the slide mechanism of a different one of the drawers.

13. The multi-drawer cabinet of claim 12, further comprising means defining a locking rod clearance space at top end of the locking rod channel above the top end of the top most locking rod when all of the drawers are closed for receiving the top end of the top most locking rod when any of the locking rods are moved upwardly in the locking rod channel as a drawer is moved from the closed position toward the open position.

14. The multi-drawer cabinet of claim 12, wherein the rod moving means comprises:

a. a cam follower attached to each of the locking rods adjacent each drawer; and, b. a cam attached to the first side wall of each of the drawers for contacting the adjacent cam follower as that drawer is moved from the closed position to the open position, thereby pushing the locking rod upwardly in the locking rod channel creating a pin means receiving space between the bottom end of that moved locking rod and the top end of the next lower locking rod for receiving the pin means of the drawer being moved.

15. The multi-drawer cabinet of claim 11, wherein the drawer lock-out mechanism further comprises:

a. an aperture formed in the first cabinet wall mounting bracket of each drawer slide mechanism in alignment with the movable locking rod means;

b. the pin means comprises a pin movably mounted to the first cabinet wall mounting bracket of each drawer slide mechanism in alignment with the aperture in the first cabinet wall mounting bracket for movement between an unlocked position protruding through the aperture and into a pin receiving space formed in the locking rod means, and a locking position retracted from the aperture in the first cabinet wall mounting bracket; and, c. pin activating means associated with the first intermediate bracket of each drawer slide mechanism for coacting with the pin means as the drawer is moved from the closed position toward the open position, i. wherein the pin activating means associated with the first intermediate bracket of the first drawer being moved from the closed position to the open position moves the pin of the pin means through the aperture in the first cabinet wall mounting bracket and into the pin receiving space created in the locking rod means to the unlocked position, and ii. wherein the pin activating means associated with the first intermediate brackets of the closed drawers abuts against the pin means in the locking position binding the first intermediate brackets of the closed drawers against movement relative to the first cabinet wall mounting brackets of the closed drawers.

16. The multi-drawer cabinet of claim 15, wherein the pin activating means further coacts with the pin means associated with the drawer slide mechanism of an open drawer as the open drawer is moved to the closed position to retract the pin of the pin means from the pin receiving space in the locking rod means to the locking position.

17. The multi-drawer cabinet of claim 16, wherein:

a. the pin means further comprises a cam follower structurally associated with the pin; and, b. the pin activating means comprises a first cam surface on the first intermediate bracket for movement therewith for contacting the cam follower of the pin means as the drawer moves from the closed position toward the open position, thereby pushing the pin of the pin means through the aperture in the first cabinet wall mounting bracket to the unlocked position, and a second cam surface on the first intermediate bracket for movement therewith for contacting the cam follower of the pin means as the drawer moves from the open position toward the closed position, thereby pulling the pin of the pin means out of the aperture in the first cabinet wall mounting bracket to the locking position.

18. The multi-drawer cabinet of claim 17, wherein the cam follower of the pin means comprises:

a. a first cam follower surface which is contacted by the first cam surface of the pin activating means as the drawer is moved from the closed position toward the open position; and, b. a second cam follower surface which is contacted by the second cam surface of the pin-activating means as the drawer is moved from the open position toward the closed position.

19. The multi-drawer cabinet of claim 17, wherein the first cam surface on the first intermediate bracket and the second cam surface on the first intermediate bracket are spaced apart from each other longitudinally of the first intermediate bracket, and the cam follower of the pin means is disposed in the space between the first cam surface and the second cam surface when the drawer is closed.

* * * * *

UNITED STATES PATENT AND TRADEMARK OFFICE

CERTIFICATE OF CORRECTION

PATENT NO. : 5,634,701

DATED : June 3, 1997

INVENTOR(S) : Ronald D. Hendrich, et al

It is certified that error appears in the above-indentified patent and that said Letters Patent is hereby corrected as shown below:

The title page should be deleted to appear as per attached title page.

Drawing Sheets 4,5, and 6 should be replaced by the attached drawing sheets.

Signed and Sealed this

Twenty-first Day of July, 1998

Bruce Lehman

*Attest:*

BRUCE LEHMAN

*Attesting Officer*

*Commissioner of Patents and Trademarks*

United States Patent [19]

Hendrich et al.

[11] Patent Number: 5,634,701

[45] Date of Patent: Jun. 3, 1997

[54] MULTI-DRAWER CABINET HAVING A DRAWER LOCK-OUT MECHANISM

[75] Inventors: Ronald D. Hendrich, New Albany, Ind.; Ghosn S. Ziady, Louisville, Ky.

[73] Assignee: FireKing International, Inc., New Albany, Ind.

[21] Appl. No.: 298,996

[22] Filed: Aug. 31, 1994

(Under 37 CFR 1.47)

[51] Int. Cl.[6] ..... E05C 7/06; A47B 88/00

[52] U.S. Cl. ..... 312/221; 312/222; 312/334.8

[58] Field of Search ..... 312/215, 217, 312/218, 219, 221, 222, 216, 220, 334.32, 334.8

[56] References Cited

U.S. PATENT DOCUMENTS

| | | | |
|---|---|---|---|
| 4,429,930 | 2/1984 | Blouin | 312/222 X |
| 4,441,767 | 4/1984 | Stark | 312/221 X |
| 4,480,883 | 11/1984 | Young | 312/221 X |
| 4,711,505 | 12/1987 | Lakso | 312/221 X |
| 4,770,476 | 9/1988 | Lakso | 312/221 X |
| 4,820,002 | 4/1989 | Lechner et al. | 312/221 |
| 4,838,627 | 6/1989 | Macias | 312/334 B |
| 4,854,653 | 8/1989 | Lakso | 312/222 |
| 4,889,396 | 12/1989 | Mitchell et al. | 312/221 |
| 4,957,334 | 9/1990 | Lakso | 312/221 |
| 4,966,423 | 10/1990 | Higuera et al. | 312/221 |
| 5,303,994 | 4/1994 | Elsholz | 312/222 X |
| 5,333,949 | 8/1994 | McGregor | 312/222 X |
| 5,411,327 | 5/1995 | Norton | 312/221 |
| 5,417,490 | 5/1995 | Hobbs et al. | 312/334.32 X |

FOREIGN PATENT DOCUMENTS

| | | | |
|---|---|---|---|
| 3633256 | 3/1988 | Germany | 312/221 |
| 2095322 | 9/1982 | United Kingdom | 312/221 |

*Primary Examiner*—Peter M. Cuomo
*Assistant Examiner*—James O. Hansen
*Attorney, Agent, or Firm*—Brooks & Kushman P.C.

[57] ABSTRACT

A multi-drawer cabinet having a cabinet housing and a plurality of drawers disposed one above the other in the housing and a slide mechanism slidably mounting each of the drawers in the housing for slidable movement between an open position extending outwardly from the housing and a closed position received entirely within the housing includes a drawer lock-out mechanism which binds the slide mechanisms of the closed drawers against slidable movement preventing a closed drawer from being opened when any of the other drawers is open.

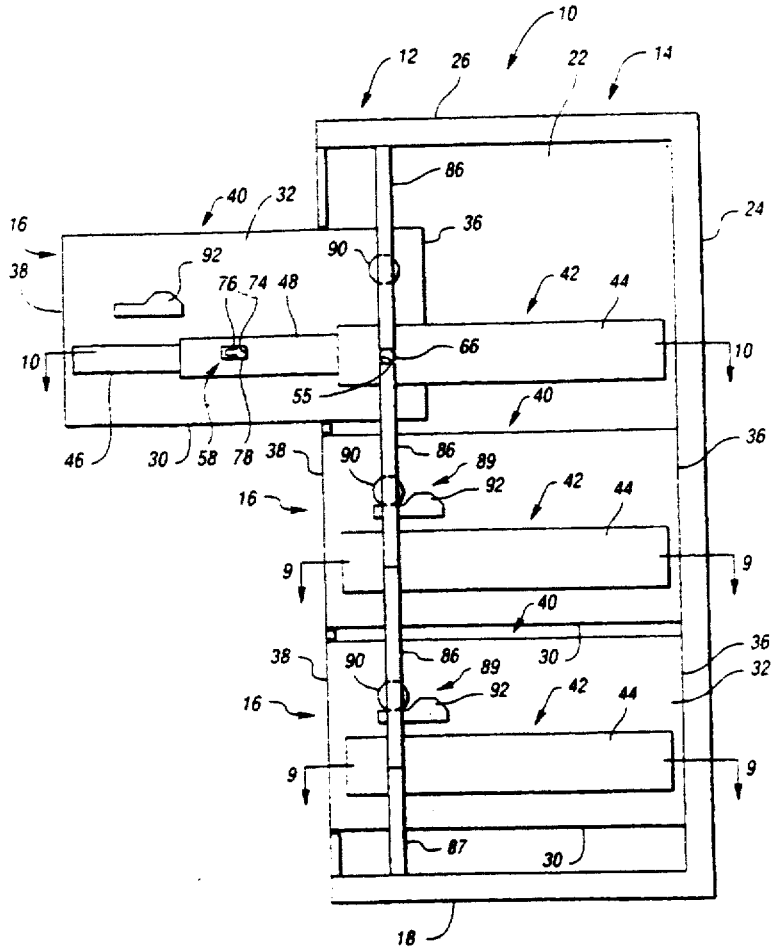

19 Claims, 7 Drawing Sheets